US010027024B2

(12) United States Patent
Powell

(10) Patent No.: US 10,027,024 B2
(45) Date of Patent: Jul. 17, 2018

(54) ANTENNA FOR VEHICLE PLATOONING

(71) Applicant: DENSO International America, Inc., Southfield, MI (US)

(72) Inventor: Patrick Powell, Farmington Hills, MI (US)

(73) Assignee: DENSO International America, Inc., Southfield, MI (US)

( * ) Notice: Subject to any disclaimer, the term of this patent is extended or adjusted under 35 U.S.C. 154(b) by 133 days.

(21) Appl. No.: 15/196,805

(22) Filed: Jun. 29, 2016

(65) Prior Publication Data

US 2018/0006365 A1 Jan. 4, 2018

(51) Int. Cl.

| | |
|---|---|
| ***H01Q 1/42*** | (2006.01) |
| ***H01Q 1/32*** | (2006.01) |
| ***H01Q 1/50*** | (2006.01) |

(52) U.S. Cl.
CPC ..... *H01Q 1/3283* (2013.01); *H01Q 1/42* (2013.01); *H01Q 1/50* (2013.01)

(58) Field of Classification Search
CPC ..... H01Q 1/42; H01Q 1/50; H01Q 1/3283
USPC ..... 343/711
See application file for complete search history.

(56) References Cited

U.S. PATENT DOCUMENTS

2011/0210895 A1* 9/2011 Buff, III ..... H01Q 1/3291 343/712
2016/0054735 A1* 2/2016 Switkes ..... G08G 1/22 701/23

* cited by examiner

*Primary Examiner* — Andrea Lindgren Baltzell
(74) *Attorney, Agent, or Firm* — Harness, Dickey & Pierce, P.L.C.

(57) ABSTRACT

An antenna for vehicle platooning. The antenna includes a housing, a light emitting element within the housing, and a conductor configured to at least one of transmit and receive radiofrequency signals.

17 Claims, 2 Drawing Sheets

ANTENNA FOR VEHICLE PLATOONING

FIELD

The present disclosure relates to an antenna for vehicle platooning.

BACKGROUND

This section provides background information related to the present disclosure, which is not necessarily prior art.

Vehicle platooning is the linking of multiple vehicles together to travel as a group, or platoon. Each vehicle is in radio communication with a lead vehicle and the other vehicles of the platoon in order to synchronize the acceleration, braking, and steering of the vehicles, which allows the vehicles to travel closely together. The lead vehicle typically controls the speed and direction of the other vehicles of the platoon. Platooning provides numerous advantages, such as the ability to increase road capacity, reduce road congestion, increase fuel economy for the following vehicles, enhance safety, provide more comfortable travel due to fewer changes in acceleration, reduce the amount of human input needed during driving, etc.

The vehicles of the platoon must be in constant communication with the lead vehicle and/or one or more of the other vehicles of the platoon in order to synchronize acceleration, braking, steering, etc. Typically, the lead vehicle transmits instructions regarding acceleration, braking, steering, etc. to the other vehicles. The instructions may be relayed from one vehicle to the next, or all of the following vehicles may be in direct communication with the lead vehicle. Thus at least the lead vehicle includes an antenna for transmitting instructions.

While current platooning systems are suitable for their intended use, they are subject to improvement. For example, it would be advantageous to have a platooning antenna that is protected by a dry, dirt free environment, and is not subject to interference by nearby metal. The present teachings provide for a platooning antenna that exhibits such as advantages, as well as numerous others as will be apparent to one skilled in the art.

SUMMARY

This section provides a general summary of the disclosure, and is not a comprehensive disclosure of its full scope or all of its features.

The present teachings include an antenna for vehicle platooning. The antenna includes a housing, a light emitting element within the housing, and a conductor configured to at least one of transmit and receive radiofrequency signals.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of select embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

Figure 1:
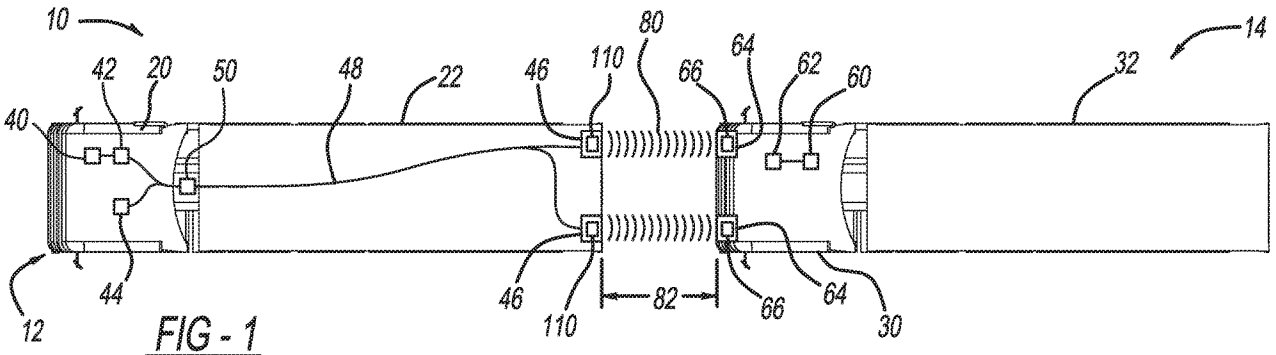
FIG. 1 illustrates a vehicle platoon including a lead vehicle and a following vehicle, the lead vehicle including taillights each having a platooning antenna according to the present teachings.

With initial reference to FIG. 1, a vehicle platoon 10 including a lead vehicle 12 and a following vehicle 14 is illustrated. Although only one following vehicle is illustrated, the platoon 10 can include any suitable number of following vehicles. The lead vehicle 12 includes a cab 20 and a trailer 22. Similarly, the following vehicle 14 includes a cab 30 and a trailer 32. Although the lead and following vehicles 12 and 14 are both illustrated as semi-trucks, the lead and following vehicles 12 and 14 can be any other vehicles suitable for traveling in a platoon, and can be the same type of vehicle or different types of vehicles (i.e., the lead and following vehicles 12 and 14 need not both be semi-trucks as illustrated).

The lead vehicle 12 includes a control module 40. The term "module" may be replaced with the term "circuit." The term "module" may refer to, be part of, or include processor hardware (shared, dedicated, or group) that executes code, and memory hardware (shared, dedicated, or group) that stores code executed by the processor hardware. The code is configured to provide the features of the control module 40 described throughout the present teachings.

The control module 40 can be any suitable control module configured to control the vehicle platoon 10, such as the acceleration, speed, braking, following distance(s), and direction of the vehicle platoon 10, to operate the platoon 10 in the safest and most efficient manner possible. To control the vehicle platoon 10, the control module 40 generates operating commands for the lead vehicle 12 and all following vehicles, including the following vehicle 14. The operating commands instruct the lead vehicle 12, the following vehicle 14, and any other following vehicles when to accelerate and at what rate, what speed to maintain, when to brake and at what rate, and the heading at which to steer at, for example.

The control module 40 is in communication with a transmitter/receiver 42 in any suitable manner, such as with a hardwire connection. The control module 40 is configured to instruct the transmitter/receiver 42 to generate electrical current corresponding to the platoon operating commands generated by the control module 40. The electrical current ultimately radiates from an antenna/taillight 110 as radiofrequency signals, as described herein. The control module 40 is also configured to decipher information, such as the operational status of the following vehicle 14 (e.g., acceleration, speed, following distance(s), heading, braking, etc.) received by the transmitter/receiver 42 in the form of electrical current corresponding to radiofrequency signals received by the antenna/taillight 110 from the following vehicle 14. The control module 40 can be configured to use any suitable transmission protocol, such as dedicated short range communication (DSRC).

The lead vehicle 12 further includes a current source 44. The current source 44 can be any current source suitable for illuminating the antenna/taillight 110. For example, the current source 44 can be the alternator of the lead vehicle 12 or any suitable battery.

Electrical current is conducted to and from the transmitter/receiver 42 to one or more taillight sockets 46 of the lead vehicle 12 in any suitable manner, such as by line 48, which can be any suitable conductor. Electrical current is also conducted from the current source 44 to the taillight sockets 46 in any suitable manner, such as by the line 48. The line 48 can thus include multiple independent conduction lines or paths. The line 48 may be or include a hardwire line extending from the taillight sockets 46, across the trailer 22, and to a pi out 50, or any other suitable connection, of the cab 20. From the pinout 50, individual current lines extend to each of the transmitter/receiver 42 and the current source 44.

Similar to the lead vehicle 12, the following vehicle 14 includes a following vehicle control module 60 and a following vehicle transmitter/receiver 62, which are connected in any suitable manner, such as by a hardwire connection. The following vehicle transmitter/receiver 62 is any suitable receiver configured to receive electrical current corresponding to radiofrequency signals transmitted from the antenna/taillight 110 of the lead vehicle 12, and received by an antenna of the following vehicle 14. The radiofrequency signals correspond to commands generated by the control module 40 for operating the following vehicle 14, such as, but not limited to, setting the acceleration, speed, heading, braking, following distance, etc. of the following vehicle 14.

The following vehicle control module 60 is any suitable controller configured to decipher the commands received by the following transmitter/receiver 62, and configured to operate the following vehicle 14 in accordance with the commands. The following vehicle control module 60 is also configured to instruct the following transmitter/receiver 62 to generate signals representing the current operational status of the following vehicle 14, which can be transmitted to the lead vehicle 12, to keep lead vehicle control module 40 informed of the operational status of the following vehicle 14. With respect to the following vehicle control module 60, the term "module" may refer to, be part of, or include processor hardware (shared, dedicated, or group) that executes code, and memory hardware (shared, dedicated, or group) that stores code executed by the processor hardware. The code is configured to provide the features of the following vehicle control module 60 described in this application.

The following vehicle 14 can include any suitable antenna configured to receive radiofrequency signals from, and transmit radiofrequency signals to, the antenna/taillight 110 of the lead vehicle 12. Radiofrequency signals transmitted by the antenna/taillight 110 of the lead vehicle 12 are illustrated at reference numeral 80 of FIG. 1. The radiofrequency signals 80 span a platoon gap 82 between the lead and following vehicles 12 and 14. The antenna of the following vehicle 14 can be similar to, or the same as, the antenna/taillight 110 of the lead vehicle 12, but configured as a headlight/antenna 66 seated within socket 64 of the following vehicle 14. The antenna/taillight 110 will now be described in further detail.

Figure 2:
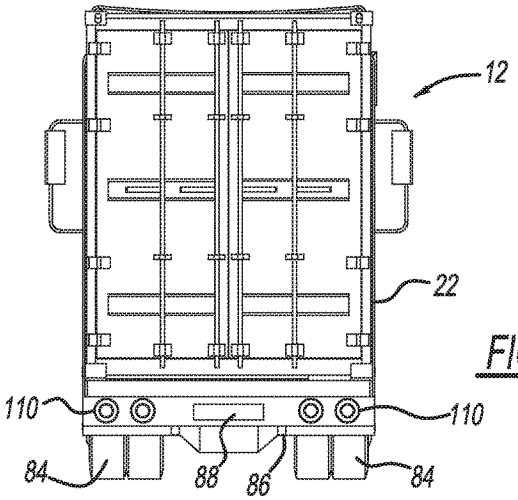
FIG. 2 is a rear view of the lead vehicle of FIG. 1.

FIG. 2 illustrates a rear portion of the lead vehicle 12. Reference numerals 84 designate rear tires of the lead vehicle 12, and reference numeral 86 designates a rear axle extending between the tires 84. A rear bumper of the lead vehicle 12 is illustrated at reference numeral 88. The antenna(s)/taillights 110 are located at the rear of the lead vehicle 12 to provide line of sight communication with the headlight/antenna 66 of the following vehicle 14.

Figure 3:
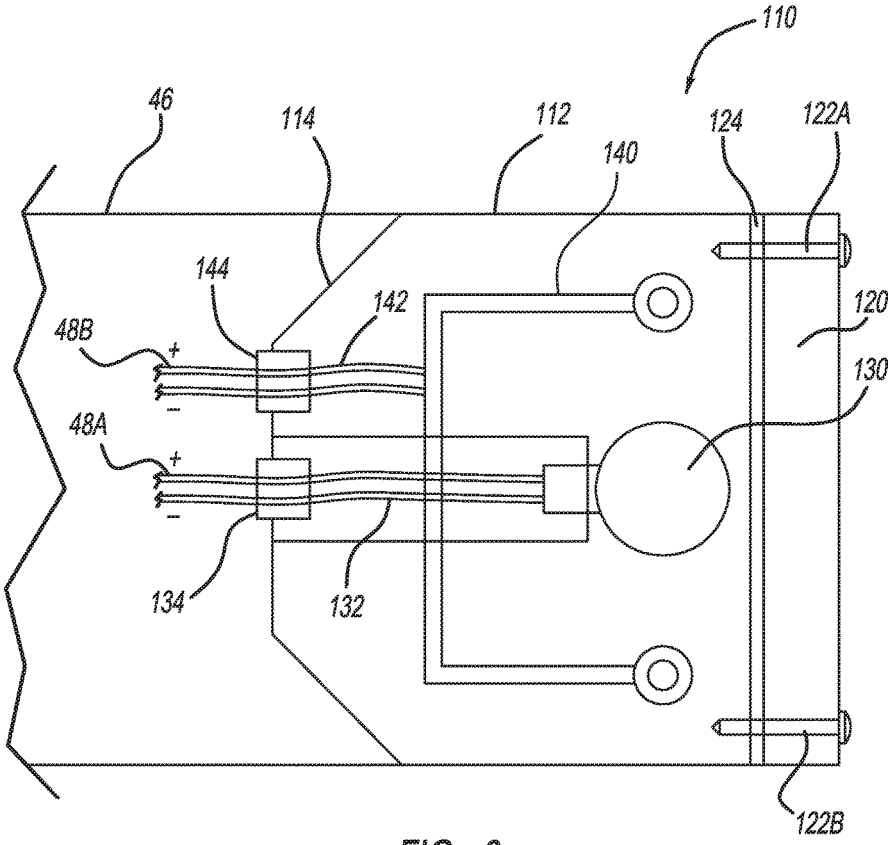
FIG. 3 is a cross-sectional view of one of the taillights of FIG. 1 including the platooning antenna according to the present teachings.

FIG. 3 is a cross-sectional view of one of the antennas/taillights 110. The antenna/taillight 110 includes a housing 112 having an exterior surface 114, which is received by, and secured within, the taillight socket 46 in any suitable manner. The housing 112 can be made of any suitable metal that will not interfere with radiofrequency transmission or reception, such as a polymeric material. A cover 120 is secured to the housing 112 with any suitable fasteners, such as a first screw 122A and a second screw 122B. Between the cover 120 and the housing 112 is a seal 124, which prevents dirt, dust, water, and other foreign materials from entering the housing 112.

Within the housing 112 is a light emitting element 130, which can be any suitable light emitting element configured to act as a vehicle taillight, such as a halogen light bulb, xenon lightbulb, or a light emitting diode, for example. Extending from the light emitting element 130 is a current conduction line 132. At or proximate to the exterior 114 of the housing 112, the current conduction line 132 is connected to the line 48 of the lead vehicle 12, and specifically to a current conduction portion 48A thereof, to deliver current from the vehicle current source 44 to the light emitting element 130. A seal 134 is provided at the connection between the lines 132 and 48A in order to prevent dirt, dust, water, etc. from contaminating the connection between the lines 132 and 48A.

Also within the housing 112 is a conductor 140, which can be any suitable metallic conductor configured to transmit and receive radiofrequency signals. One or more of the antennas/taillights 110 can include the conductor 140. The antennas/taillights 110 without the conductor 140 are merely configured as conventional taillights.

The conductor 140 is connected to an antenna transmission line 142, which extends to the exterior surface 114 of the housing 112. At or proximate to the exterior surface 114 of the housing 112, the antenna transmission line 142 is connected to the line 48 of the lead vehicle 12. Specifically, the antenna transmission line 142 is connected to portion 48B of the line 48, and the connection therebetween is sealed with any suitable seal 144 to prevent contamination of the connection by dirt, dust, water, etc.

The present teachings thus advantageously provide an antenna/taillight 110 that can act not only as a taillight, but as an antenna too. Existing vehicles can therefore be easily retrofitted with a platooning system by replacing one or more of their current taillights with the antenna/taillight 110 according to the present teachings, which can be configured for any suitable vehicle, such as semi-trucks as illustrated, passenger vehicles, mass transit vehicles, military vehicles, etc. One skilled in the art will recognize that existing vehicle wire harnesses and pinouts, such as of semi-trucks, can be used for lines conducting electrical signals between the conductor 140 and the control module 40. The position of the antenna/taillight 110 at a rear of the lead vehicle 12 advantageously permits line of sight communication with the following vehicle 14. The polymeric housing 112 and position of the antenna/taillight 110 away from surrounding metal prevents interference. Furthermore, the housing 112 protects the conductor 140 by providing a dry environment that is free of dirt, dust, and other contaminants. One or more of the headlights 66 of the following vehicle 14 can be configured like the antenna/taillight 110. The only substantial difference between the antenna/taillight 110 and the headlights 66 configured with an antenna is that the light emitting element 130 is configured as a headlight as opposed to a taillight.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. An antenna for vehicle platooning, the antenna comprising:

a housing;

a light emitting element within the housing; and a conductor within the housing configured to at least one of transmit and receive radiofrequency signals;

wherein the housing is configured for receipt by at least one of a taillight socket and a headlight socket of a vehicle.

2. The antenna of claim 1, further comprising a cover sealed to the housing.

3. The antenna of claim 2, wherein the cover is removably sealed to the housing with at least one fastener; and wherein a seal is between the cover and the housing.

4. The antenna of claim 1, wherein the light emitting element includes at least one of a light bulb and a light emitting diode.

5. The antenna of claim 1, wherein the conductor is a metallic element.

6. The antenna of claim 1, wherein the conductor is sealed within the housing.

7. The antenna of claim 1, further comprising an antenna transmission line configured to couple with a vehicle transmission line when the housing is seated within a taillight socket or a headlight socket of a vehicle.

8. The antenna of claim 1, further comprising an antenna current conduction line extending from an exterior of the housing to the light emitting element, the antenna current conduction line is configured to couple with a current source onboard a vehicle to conduct current to the light emitting element for illumination of the light emitting element when the housing is seated within a taillight socket or a headlight socket of a vehicle.

9. A system for transmitting vehicle operating commands from a lead vehicle of a vehicle platoon to a following vehicle, the system comprising:

a lead vehicle controller configured to generate the vehicle operating commands for the following vehicle;

a transmitter of the lead vehicle configured to transmit the vehicle operating commands to the following vehicle by way of an antenna; and the antenna includes a housing having a conductor configured to transmit radiofrequency signals, and a light emitting element;

wherein the housing of the antenna is configured for receipt by at least one of a taillight socket and a headlight socket of a vehicle.

10. The system of claim 9, wherein the vehicle operating commands include acceleration, braking, following distance, and steering commands.

11. The system of claim 9, further comprising a vehicle transmission line connecting the transmitter to the antenna.

12. The system of claim 11, wherein the vehicle transmission line includes a first portion extending directly from the transmitter of the lead vehicle, and a second portion extending across a trailer of the lead vehicle to the antenna at a taillight of the lead vehicle;

wherein the first portion is connected to the second portion with a pin and socket connection.

13. The system of claim 9, wherein the light emitting element includes at least one of a light bulb and a light emitting diode.

14. The system of claim 9, wherein the light emitting element is a taillight of the lead vehicle.

15. The system of claim 9, wherein the housing includes a first seal and a second seal both at an exterior of the housing;

wherein the first seal is configured to seal a first connection between a vehicle transmission line of the lead vehicle and an antenna transmission line of the antenna that extends to the conductor; and wherein the second seal is configured to seal a second connection between a vehicle current conduction line and an antenna current conduction line configured to conduct current from a current source to the light emitting element to illuminate the light emitting element.

16. The system of claim 9, wherein the antenna is a lead vehicle antenna seated within a taillight socket of the lead vehicle, the system further comprising:

a following vehicle antenna including a housing containing both a conductor configured to receive radiofrequency signals and a headlight.

17. The system of claim 16, wherein the lead vehicle antenna and the following vehicle antenna are within line-of-sight of each another.

* * * * *